United States Patent [19]

Schwemberger

[11] Patent Number: 4,489,867

[45] Date of Patent: Dec. 25, 1984

[54] ARM BAND CARRYING DEVICE

[76] Inventor: Michael Schwemberger, 1280 Panorama Dr., Lafayette, Calif. 94549

[21] Appl. No.: 412,769

[22] Filed: Aug. 30, 1982

[51] Int. Cl.[3] ..... A45F 5/00

[52] U.S. Cl. ..... 224/222; 224/219; 224/220; 224/901

[58] Field of Search ..... 224/222, 219, 221, 267, 224/254, 255, 182, 220, 229, 901

[56] References Cited

U.S. PATENT DOCUMENTS

| | | | |
|---|---|---|---|
| 3,124,286 | 3/1964 | Dompier | 224/220 X |
| 3,372,438 | 3/1968 | Rinecker | 224/901 X |
| 3,543,977 | 12/1970 | Lockridge | 224/222 |
| 4,096,863 | 6/1978 | Kaplan et al. | 224/901 X |
| 4,341,331 | 7/1982 | McDougall | 224/219 |

*Primary Examiner*—Steven M. Pollard

[57] ABSTRACT

A band worn on the user's arm or wrist has a short strap which carries a small item for occasional use such as a key. The strap has a captive end which is connected to the band, and a free end which retains the small item. The strap extends from the band in an access position, and is sufficiently long to permit the user to manipulate the small item using the thumb and forefingers on the same arm with the band. The band and the free end of the strap have selectively positioned loop-and-pile fasteners thereon for releaseably securing the strap around the band in a concentric storage position. The small item retained at the free end of the strap is stored between the strap and the band in the concentric storage position. For use, the user pulls the strap away from the band with his opposite hand releasing the band and the small item from the storage position into the access position.

14 Claims, 8 Drawing Figures

ARM BAND CARRYING DEVICE

TECHNICAL FIELD

This invention relates to an arm band type carrying device, and more particularly to such a device having an access mode and a storage mode.

BACKGROUND

Heretofore, wrist band devices with retaining chains and straps were available for securing small items such as a coin purse (U.S. Pat. No. 23,401 to Hudson 1893), a whistle (France 999,367 to Maran 1949), and a key (U.S. Pat. No. 3,124,286 to Dompier 1964). These devices were designed to retain the item in a dangling "standby" position proximate the wearer's hand, continuously available for immediate use.

These small items visibly suspended from the user's wrist, creating a swinging, jingling nuisance with neither aesthetic nor security considerations. These conspicuous small items of value were constantly available for theft as well as exposed to all of the elements and hazards of the user's environment (dirt, grease, abrasives, oxidation, corrosion). Foreign particles picked up by retained keys were particularly troublesome to the delicate tumbler mechanism in the lock which must interface with the key. The carried item frequently knocked against environmental structures and was nicked or damaged. Sometimes the carried item became snagged and was torn loose from the retainer chain and lost. The dangling feature of these prior art devices created a special hazard around industrial machinery or electronic apparatus. Entanglement of the dangling item and chain could cause the user to be pulled into a mechanical device or electrically shocked.

Rapid movement or sudden changes in direction of the wearer's arm and hand caused the carried item to jerk at the end of the retaining chain and whip around dangerously. Such random high velocity motion of the carried item was a hazard to the nearby people and environmental articles.

No provision was made in these prior art devices for a storage position in which the retained items were carried in a less prominent position adjacent to the wearer's arm; and then covered, immobilized, and completely secured. The constant access feature of these prior art devices was the convenience, and also the source of the above problems.

Loop and pile holding straps have been employed previously to secure equipment in an immobile storage position (U.S. Pat. No. 3,543,977 to Lockridge, U.S. Pat. No. 3,947,927 to Rosenthal, and U.S. Pat. No. 4,149,540 to Hasslinger). However these tie straps have not been employed in a dual mode storage-use device.

SUMMARY

It is therefore an object of this invention to provide an arm mounted, dual mode, carrying device for retaining a small item in a storage position and in an access position.

It is another object of this invention to provide such a carrying device in which the retained item is covered during non-use and isolated from the hazards of the user's environment.

It is a further object of this invention to provide such a carrying device in which the retained item may be hidden from view when not in use.

It is a further object of this invention to provide such a carrying device in which the retained item is immobile when in the storage position.

It is a further object of this invention to provide such a carrying device in which the retained item is completely secured when in the storage position.

Briefly, these and other objects of the present invention are accomplished by providing a dual mode carrying device adapted to be worn on a person's arm for holding at least one small item for occassional use by the person. The carrying device has a storage mode in which the at least one small item is stored adjacent to the person's arm, and an access mode in which the at least one small item is accessable for use by the person. The carrying device is formed by a flat annular band member adapted to fit snugly around the person's lower arm, and a flat strap member. The strap has a captive end connected to the band member, and a free end which may be wrapped around the band and secured thereto defining a concentric storage position. Alternatively, the free end of the strap may be free defining an access position. An item retaining structure at the free end of the strap member is adapted to retain the small item. Releasable securing means on the band member and on the strap member proximate the free end thereof, releasably engage to secure the strap member in the concentric storage position about the band member. A grasping structure is provided on the strap member at the free end thereof for permitting the person to pull the strap member away from the band member causing the securing means to release and moving the strap member from the storage position into the access position.

BRIEF DESCRIPTION OF THE DRAWING

Further objects and advantages of the present carrying device, and the operation of the dual mode stap will become apparent from the following detailed description and drawing in which.

DETAILED DESCRIPTION

Figure 1A:
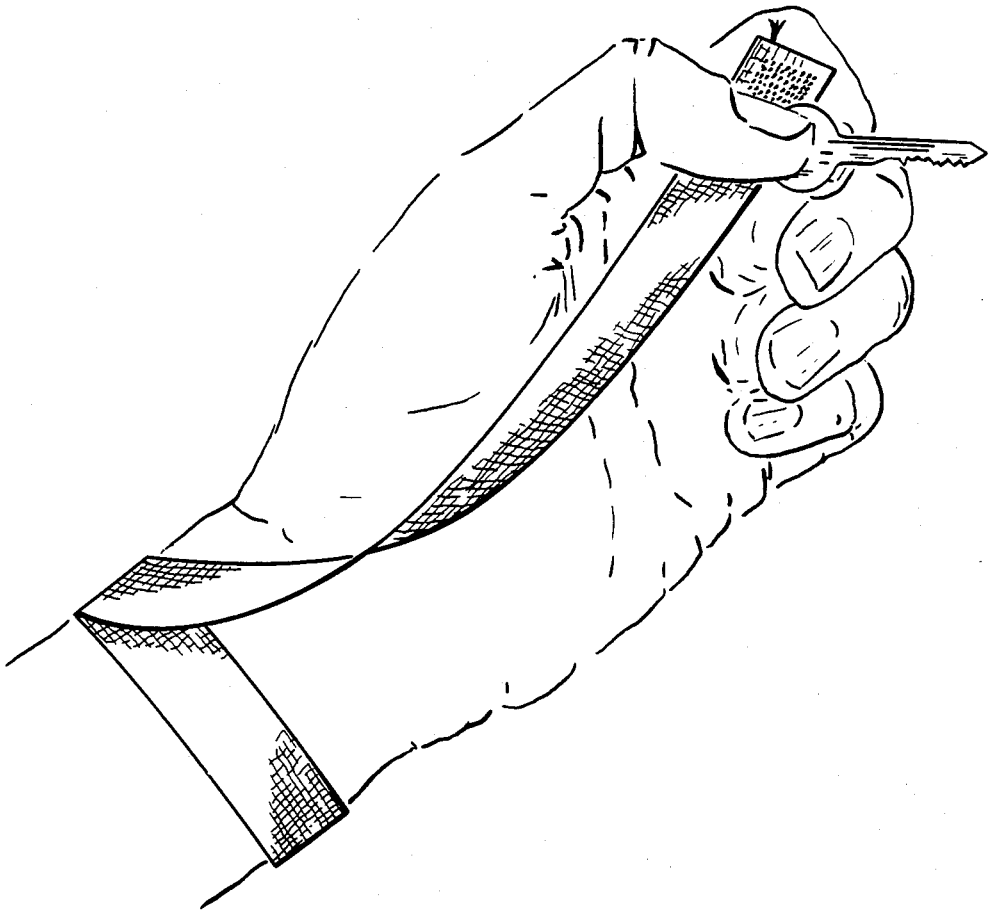
FIG. 1A shows the carrying device in use by a wearer.
Figure 1B:
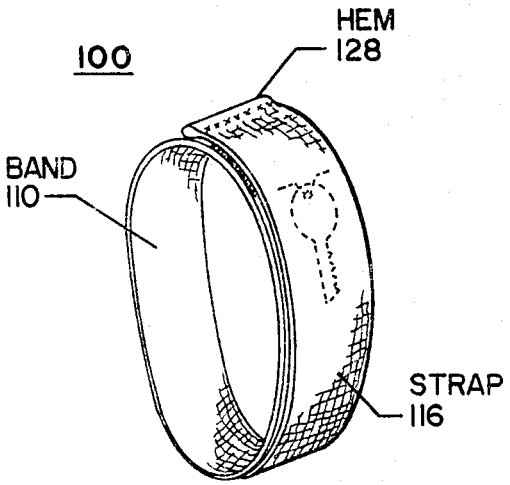
FIG. 1B shows the carrying device in the storage mode.
Figure 1C:
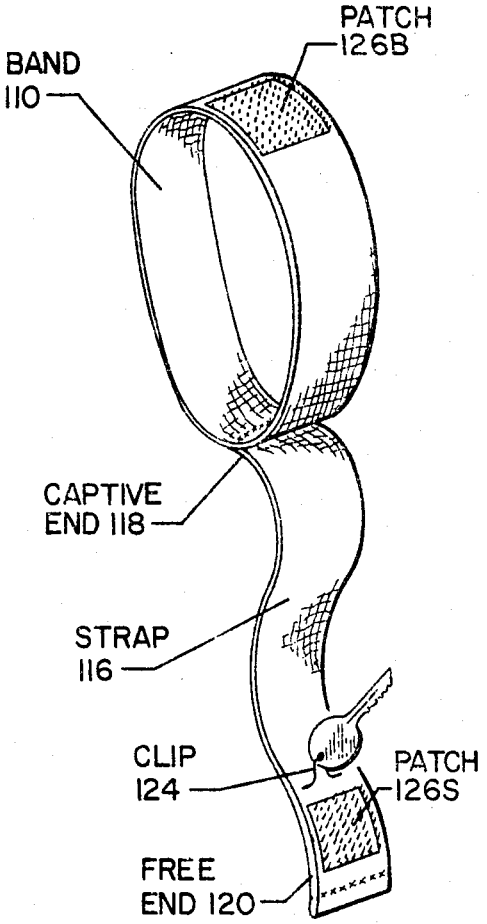
FIG. 1C shows the carrying device in the access mode.

FIGS. 1B and 1C show an arm worn carrying device 100 which carries at least one small item such as a key for occasional use as shown in FIG. 1A. Device 100 has a storage mode (1B), in which the small item is secured against the user's arm; and an access mode (1C) in which the item is accessable for use.

A flat annular band 110 encircles the user's forearm or wrist. A flap strap 116, connected to band 110 at captive end 118, retains the small item at free end 120 thereof. Strap 116 may have a suitable item retaining structure, such as clip 124. Free end 120 has a suitable releaseable securing means, such as a patch 126S of fabric fastener material, which releaseably engages a cooperating patch 126B on band 110. Patches 126S and 126B are preferably the VELCRO brand hook and pile fasteners sold by Velcro Corporation, 681 Fifth Avenue, New York, N.Y.; and described in U.S. Pat. Nos. 2,717,437 and 3,009,235, which patents are hereby incorporated by reference in their entirety.

Band securing patch 126B is selectively positioned along band 110 to permit engagement with strap patch 126S when strap 116 is concentrically wrapped around band 110 in the storage position as shown in FIG. 1B.

During the storage mode, the small item is covered by strap 116 and generally immobilized or nested between strap 116 and band 110. The user grasps free end 120 along hem 128 and pulls strap 116 away from band 110 into the access position as shown in FIG. 1C. Strap 116 has sufficient length to extend from band 110, along the user's arm, to the user's hand on the carrying arm. When strap 116 is in the access position, the small item may be manipulated by the user's thumb and fingers.

The dual mode operation of device 100 permits ready access of the small item, along with a highly secure storage between uses. Strap 116 and the small item never dangle freely from band 110. During the storage mode, the item is secure between strap 116 and band 110; and during the access mode, the item is held in one of the user's hands. The small item is at all times either hidden from view in the storage position, or under direct control of the user in the access position. When not in use, the small item is not subject to abrasion from the surrounding environment, theft, loss, entanglement, or any of the other problems associated with the single mode, free dangling prior art devices.

OPERATION

The storage mode and access mode exhibit a cooperation which creates a surprising convenience for the user, as is illustrated in the following example. The user is a housewife returning from a shopping errand. During the shopping tour, the user's door key is secured to clip 124 in the storage position under strap 116. The door key is free from abuse and entanglement as the user drives, selects merchandise, makes change, etc. Upon returning home, the housewife approaches her door clutching several packages in her arms. Initially both the user's band arm and other arm are engaged in holding the packages. The user temporarily transfers the primary load of the packages to her band arm and band hand; and reaches over with her other hand to grasp the end of strap 116 pulling the strap loose from band 110. After placing the end of strap 116 and the door key in her band hand, the user re-transfers the package load, partially or entirely, to her other arm. The user's band arm and band hand are now partially or entirely free to insert the key and unlock the door. Under a severe package load, the user may rest against the door frame to partially support the load thereagainst. In this situation, the user may have less hand freedom than in the normal load situation. The user pulls strap 116 loose, permitting the key to fall to a predetermined position defined by the length of strap 116. The user simply drops her arm catching the key in her hand.

The carrying device is particularly useful to high school students who must return to their lockers many times each day. The locks may be either key or combination operated. The key locks are inherently easier to operate. However, most students prefer the combination locks because of the inconvenience of carrying (and probably loosing) the key. Except for the most skilled, combination locks require the use of both hands while simultaneously holding books, papers, pencils etc. The present carrying device reduces the inconvenience and loss factors associated with keys; and permits the user to open his locker faster, with less hassle. The carrying device is ideal for students, joggers, swimmers, bikers, and active people in general.

If desired, device 100 may be worn up on the user's forearm in a retracked, out-of-the way position, concealed under the user's sleeve. The user may relocate band 110 to the lower, usual position, prior to use in order to maintain the desired access position-to hand relationship. Band 110 may be pushed up and down the user's band arm by the user's other hand, or simply shook down into the lower position without the aid of the other hand. Alternatively, strap 116 may be lengthened for upper arm located bands.

Device 100 is preferrable put on by passing band 110 over the user's band hand. Band 110 may be made of an elastic material which expands in circumference in order to accommodate the wider dimensions of the user's hand. The elastic feature facilatates a range of different size lower arms and wrists among wearer's. In addition, this elastic expansion permits the device to be positioned high up on the wearer's arm, or along the small lower arm-wrist region.

Figure 2:
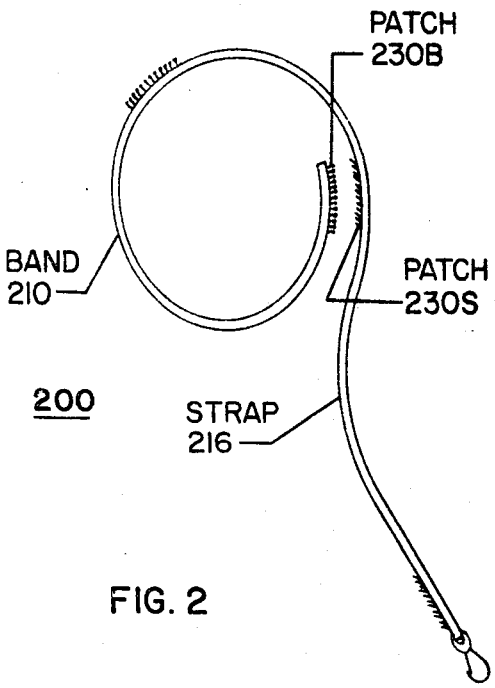
FIG. 2 shows the device formed by a single piece of material.

FIG. 2 shows carry device 200 formed of a single piece of elastic material affixed together at captive end 218, to permit expansion in band 210 and strap 216. The strap expansion provides a convenient reserve length in strap 216 during the access mode. In addition, the strap expansion accommodates various shaped retained items during the storage mode. If desired, the connection at captive end 218 which forms the band may be a releaseble fastening device, permitting the wearer to remove device 200 by unwrapping strap 216 beyond the access position. FIG. 2 shows the band-strap fastened by additional loop and pile patches 230S and 230B sewn on strip 200.

The width and snugness of band 210 is preferrably sufficient to engage the user's arm without sliding up and down or around. The width of strap 216 may be identical to band 210 for appearance design consideration, and is preferrable width enough to cover the small retained item.

Figure 3:
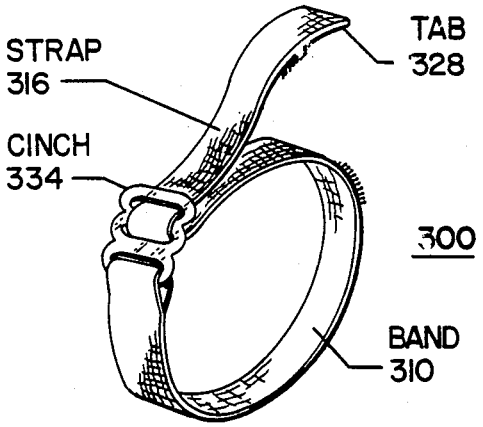
FIG. 3 shows an adjustable band device.

Device 300 shown in FIG. 3 has a buckle or cinch ring 334 in band 310 (FIG. 3) for securing the band around the user's arm. Device 300 has a grasping tab 328 at free end 320, extending beyond strap patch 326S to enable the user to more easily grasp strap 316.

Figure 4:
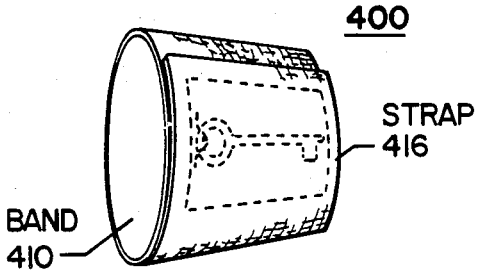
FIG. 4 shows a cuff device.

FIG. 4 shows a cuff embodiment 400 with an extra wide band 410 and strap 416, for carrying elongated items such as the old style door key shown in hidden lines.

Figure 5:
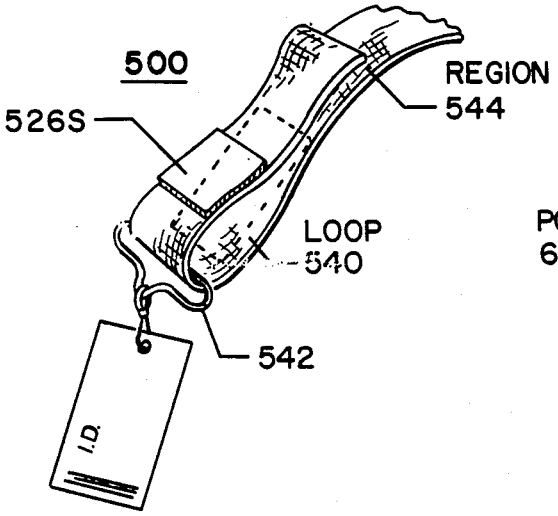
FIG. 5 is a fragmentary view showing a fold-back at the free end of the strap.

A fold-back end loop 540 is shown in FIG. 5. Loop 540 passes through an elongated retainer ring 542 which has a retainer clip 524 and a suitable small item, such as a magnetic code identification card, attached thereto. The card is shown in a outer or operational position. Ring 542 may be twisted around on loop 540, causing clip 524 and the ID card to slip into an inner protective position between the two folds of end loop 540. End loop 540 may be permanently formed by stitching at region 544, or may be releaseably formed by loop-and-pile patches.

Figure 6:
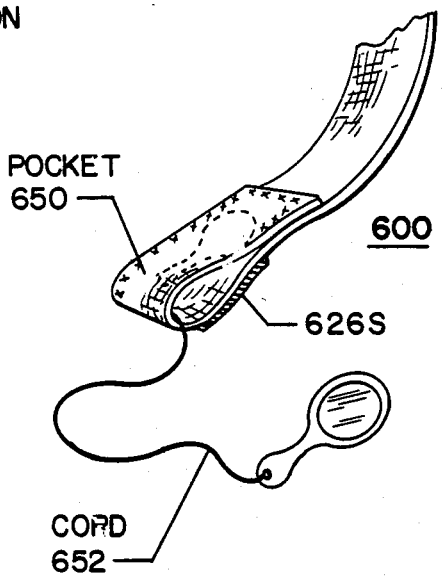
FIG. 6 is a fragmentary view showing a pocket and extender cord at the free end of the strap.

An end pocket 650 is shown in FIG. 6, for holding a delicate item requiring a high degree of protection such as optical glass. The glass is shown in hidden lines within protective pocket 650, and in full lines removed from pocket 650 for use. An suitable extender-connector, such as elastic cord 652, is provided to connect the glass with pocket 650. Cord 652 permits an extended range of use of the glass, while preventing the glass from falling or being mislaid and left unprotected.

INDUSTRIAL APPLICABILITY

It will be apparent to those skilled in the art that the objects of this invention have been achieved by providing a dual mode carrying device for small items. In the storage mode, the retained item is secured close to the wearer's arm, in a covered, immobile position, by the concentric position of the strap. In the access mode, the retained item is available for use, tethered on the end of the strap.

CONCLUSION

Clearly various changes may be made in the structure and embodiments shown herein without departing from the concept of the invention. Further, the features of the embodiments shown in the various Figures may be employed with the embodiments of the other Figures.

Therefore, the scope of the invention is to be determined by the terminology of the following claims and the legal equivalents thereof.

I claim as my invention:

1. A carrying device adapted to be worn on a person's arm for holding at least one small item for occasional use by the person, the carrying device having a storage mode in which the at least one small item is stored adjacent to the person's lower arm and an access mode in which the at least one small item is accessable for use by the person, the carrying device comprising:

a flat annular band member adapted to fit snugly around the person's lower arm, and having sufficient width so as to prevent slipping and twisting on the person's arm;

an opague flat strap member having a captive end connected to the band member and a free end, the free end having a storage position in which the strap member is secured concentrically around and over the band member adjacent to the person's lower arm with the at least one small item stored and substantially obscured between the band member and the opaque strap member, and the free end having an access position in which the free end is released from the band member, the strap member has sufficient length when in the access position to permit the at least one small item retained on the free end thereof to be conveniently manipulated by the person using the hand of the arm on which the carrying device is worn;

item retaining means at the free end of the strap member adapted to retain the at least one small item on the free end of the strap member when in the access position;

band securing means on the band member;

strap securing means on the strap member proximate the free end thereof for releaseably engaging the band member securing means to secure the strap member in the concentric storage position over the band member; and grasping means on the strap member at the free end thereof for permitting the person to pull the strap member away from the band member causing the securing means to release and moving the strap member from the storage position into the access position; wherein the band member and the strap member are formed of a single piece of flat material.

2. The carrying device of claim 1, wherein the securing means are a loop and pile securing material.

3. The carrying device of claim 1, further comprising a flexible extending means connecting the item retaining means to the free end of the strap member.

4. The carrying device of claim 1, further comprising means for adjusting the circumference of the band member.

5. The carrying device of claim 4, wherein the band member is formed of an elastic material to permit expansion.

6. The carrying device of claim 1, wherein the grasping means is formed by the thickness of the strap member at the free end thereof.

7. The carrying device of claim 1, wherein the grasping means is formed by an unsecured end portion at the free end of the strap member.

8. The carrying device of claim 1, wherein the item retaining means is a clipping device attached to the free end of the strap member.

9. The carrying device of claim 1, wherein the item retaining means is formed by a fold-back in the strap member at the free end thereof.

10. The carrying device of claim 9, wherein the item retaining means additionally comprises:

an elongated ring member captured in the fold-back in the strap member; and an item retaining clip on the ring member.

11. The carrying device of claim 10, wherein the ring member may be rotated through the fold-back defining two item positions;

an inner item position in which the retaining clip and the item are nested between the adjacent portions of the strap member forming the fold-back; and an outer item position in which the retaining clip and the item extend away from the fold-back.

12. The carrying device of claim 9, wherein the fold-back is a permanent storage pocket formed at the free end of the strap member.

13. The carrying device of claim 12, further comprising an extender cord having one end fastened to the strap member proximate the pocket and the other end connected to the item retaining means, and having a pocket position in which the cord and item are nested in the pocket, and having an extended position in which the cord extends from the strap member.

14. The carrying device of claim 9, further comprising:

releaseable fold-back securing means for releaseably forming the fold-back by releaseably securing the fold-back to the adjacent portion of the strap member.

* * * * *